US011378260B2

(12) United States Patent
Bonucci

(10) Patent No.: US 11,378,260 B2
(45) Date of Patent: Jul. 5, 2022

(54) MOUNTING FIXTURE FOR MOUNTING AN LED CONNECTOR ASSEMBLY

(71) Applicant: Tyco Electronics Brasil Ltda., Braganca Paulista (BR)

(72) Inventor: Gustavo Bonucci, Braganca Paulista (BR)

(73) Assignee: Tyco Electronics Brasil LTDA

( * ) Notice: Subject to any disclaimer, the term of this patent is extended or adjusted under 35 U.S.C. 154(b) by 0 days.

(21) Appl. No.: 16/896,368

(22) Filed: Jun. 9, 2020

(65) Prior Publication Data

US 2021/0381677 A1 Dec. 9, 2021

(51) Int. Cl.

| | |
|---|---|
| ***F21V 19/00*** | (2006.01) |
| ***F21V 23/06*** | (2006.01) |
| *H01R 24/68* | (2011.01) |
| *F21Y 115/10* | (2016.01) |

(52) U.S. Cl.

CPC ..... *F21V 19/003* (2013.01); *F21V 23/06* (2013.01); *F21Y 2115/10* (2016.08); *H01R 24/68* (2013.01)

(58) Field of Classification Search

CPC .... H01R 12/71; H01R 13/10; H01R 12/7076; H01R 12/57; H01R 24/38; H01R 35/04; H01R 31/06; H01R 24/68; H05K 1/00; F21V 19/003; F21V 23/06; F21V 19/004; F21Y 2115/10; F21S 43/14; F21S 43/195

See application file for complete search history.

(56) References Cited

U.S. PATENT DOCUMENTS

| | | | | |
|---|---|---|---|---|
| 4,778,409 | A * | 10/1988 | Maddock | H01R 33/22 439/735 |
| 2008/0100771 | A1* | 5/2008 | Ableitner | G02B 6/0021 349/61 |
| 2009/0155017 | A1* | 6/2009 | Wittman | B29C 45/2618 411/366.3 |
| 2016/0244234 | A1* | 8/2016 | Mayer | A61B 50/3001 |
| 2018/0048085 | A1* | 2/2018 | Fuda | H01R 13/44 |

* cited by examiner

*Primary Examiner* — Rajarshi Chakraborty
*Assistant Examiner* — Glenn D Zimmerman

(57) ABSTRACT

A mounting frame and an LED assembly. The mounting frame has a mounting opening which extends from a first surface of the mounting frame toward a second surface of the mounting frame. Centering ribs are provided about a circumference of the mounting opening. The centering ribs are spaced from the first surface. Retention projections are provided about the circumference of the mounting opening. The retention projections are spaced from the centering ribs.

11 Claims, 5 Drawing Sheets

MOUNTING FIXTURE FOR MOUNTING AN LED CONNECTOR ASSEMBLY

FIELD OF THE INVENTION

The present invention is directed to a mounting fixture for mounting an LED connector assembly. In particular, the invention is directed to a mounting fixture which do not require additional mounting hardware.

BACKGROUND OF THE INVENTION

LED are used in many applications, including, but not limited to automotive applications. When mounting or securing the LEDs, mounting hardware, such as nuts, are used to secure the LEDs in position. The use of mounting hardware adds expense and requires additional parts. In addition, as space is often at a premium, the use of mounting hardware may require increased space, which is not desirable.

Mounting hardware may also increase the complexity of the mounting of the LEDs. As LEDs are often mounted in tight spaces, the ability to use tooling to mount the LEDs is limited due to the particular space configurations.

It would be, therefore, be beneficial to provide a mounting fixture for mounting an LED connector assembly which avoids the problems described above. In particular, it would be beneficial to provide a mounting fixture which does not require additional mounting hardware.

SUMMARY OF THE INVENTION

An embodiment is directed to a mounting frame for mounting an LED connector assembly. The mounting frame has a mounting opening which extends from a first surface of the mounting frame toward a second surface of the mounting frame. Centering ribs are provided about a circumference of the mounting opening. The centering ribs are spaced from the first surface. Retention projections are provided about the circumference of the mounting opening. The retention projections are spaced from the centering ribs.

An embodiment is directed to an LED assembly. The LED assembly includes a mounting frame and an LED connector. The mounting frame include a mounting opening which extends from a first surface of the mounting frame toward a second surface of the mounting frame. Centering ribs are provided about a circumference of the mounting opening. The centering ribs are spaced from the first surface. Retention projections are provided about the circumference of the mounting opening. The retention projections are spaced from the centering ribs. The LED connector is positioned in the mounting opening. The LED connector has a mounting portion with a positioning portion and a threaded portion. The positioning portion is positioned to cooperate with the centering ribs to center the LED connector in the mounting opening. The threaded portion is positioned to cooperate with the retention projections to secure the LED connector in the mounting opening of the mounting frame.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
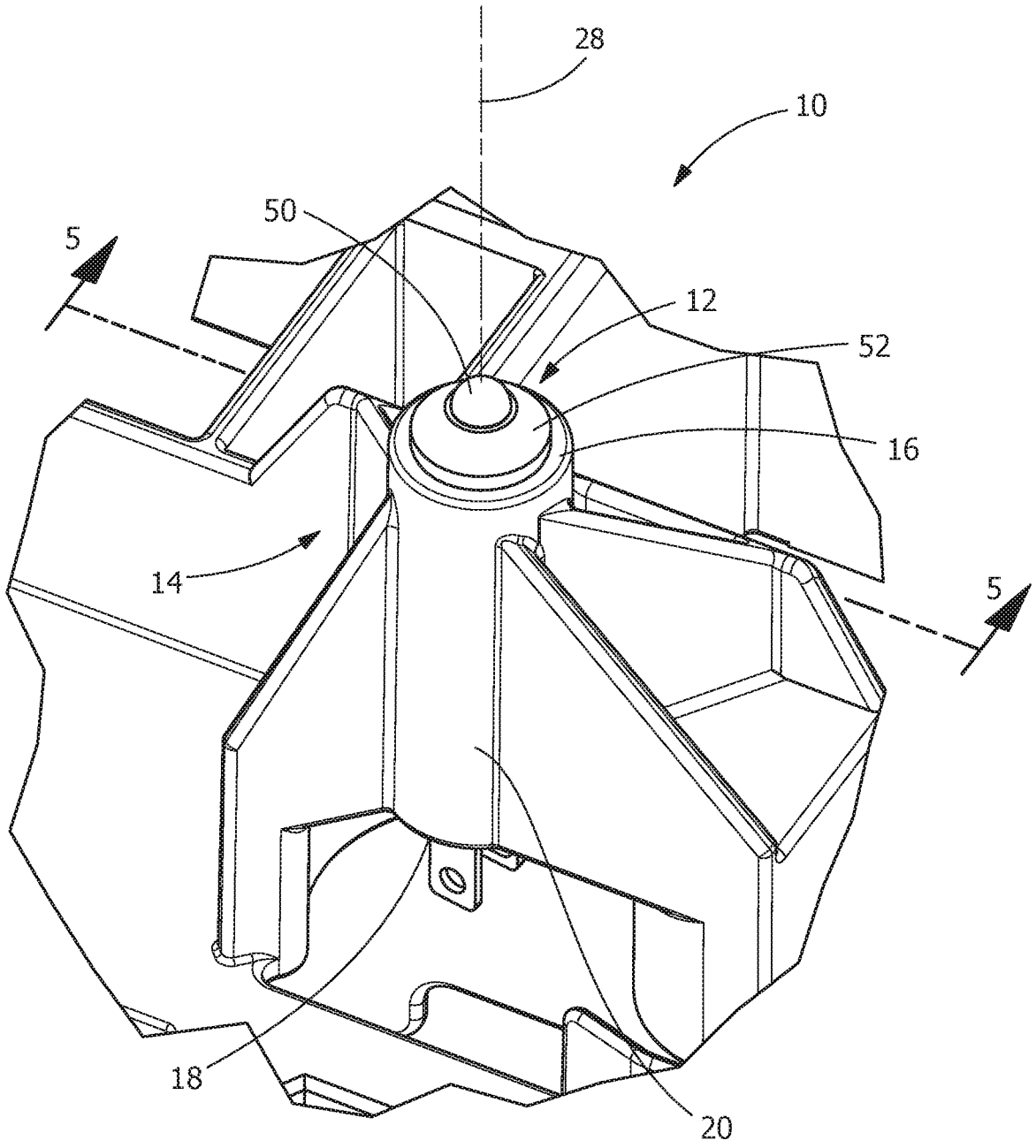
FIG. 1 is a perspective view of an illustrative frame member with an LED assembly mounted in an opening of a mounting member of the frame member.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIG. 1, a portion of a panel or frame 10 is shown. The panel or mounting frame 10 can be used to mount components, such as, but not limited to LED connector assembly 12. The panel or frame 10 may be used in different application, including, but not limited to, automotive applications.

The frame 10 includes a LED mounting area 14 which extends from a first surface 16 of the frame to an oppositely facing second surface 18. An LED mounting member 20 is provided in the mounting area 14 and extends from the first surface 16 to the second surface 18. In the embodiment shown, the mounting member 20 has a cylindrical configuration, however, other configurations may be used.

Figure 2:
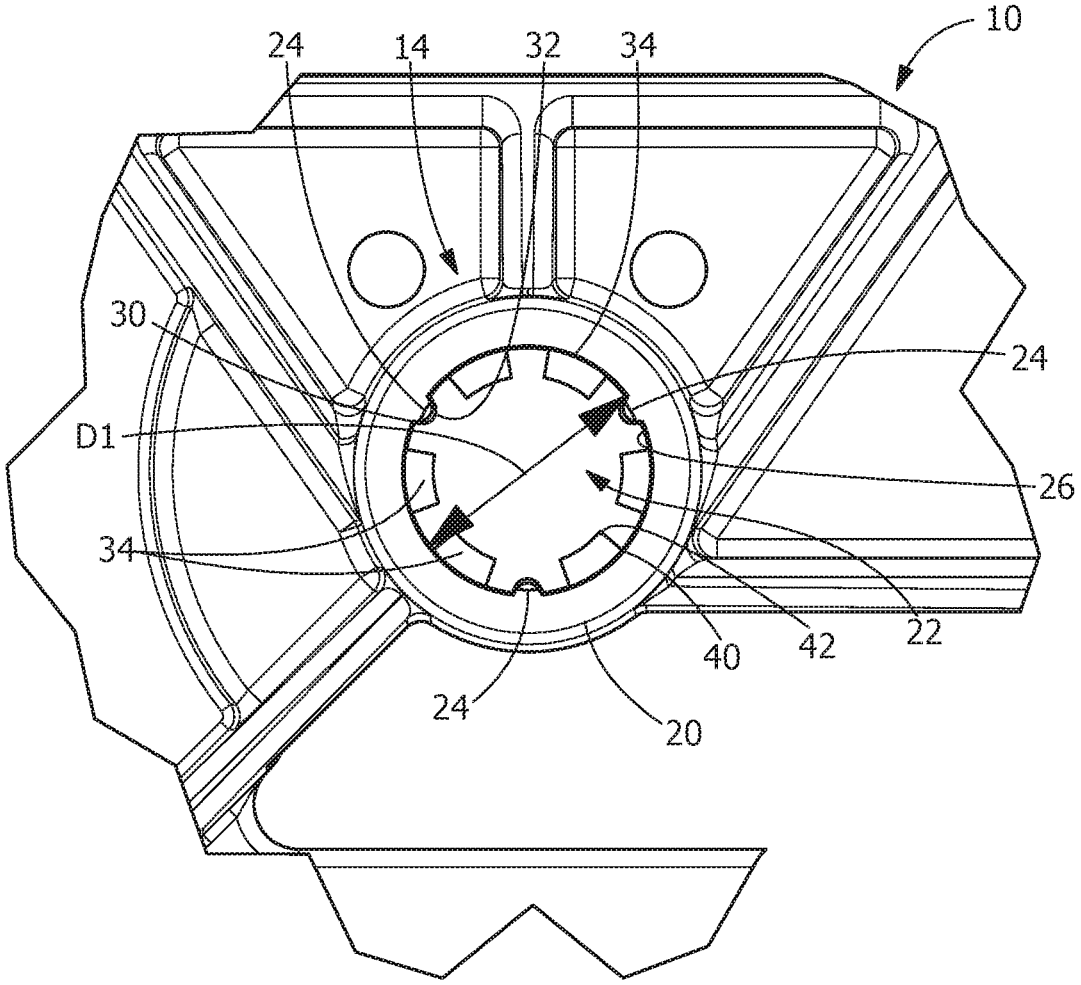
FIG. 2 is a top view of the opening of the mounting member of the frame member with no LED assembly provided therein.
Figure 6:
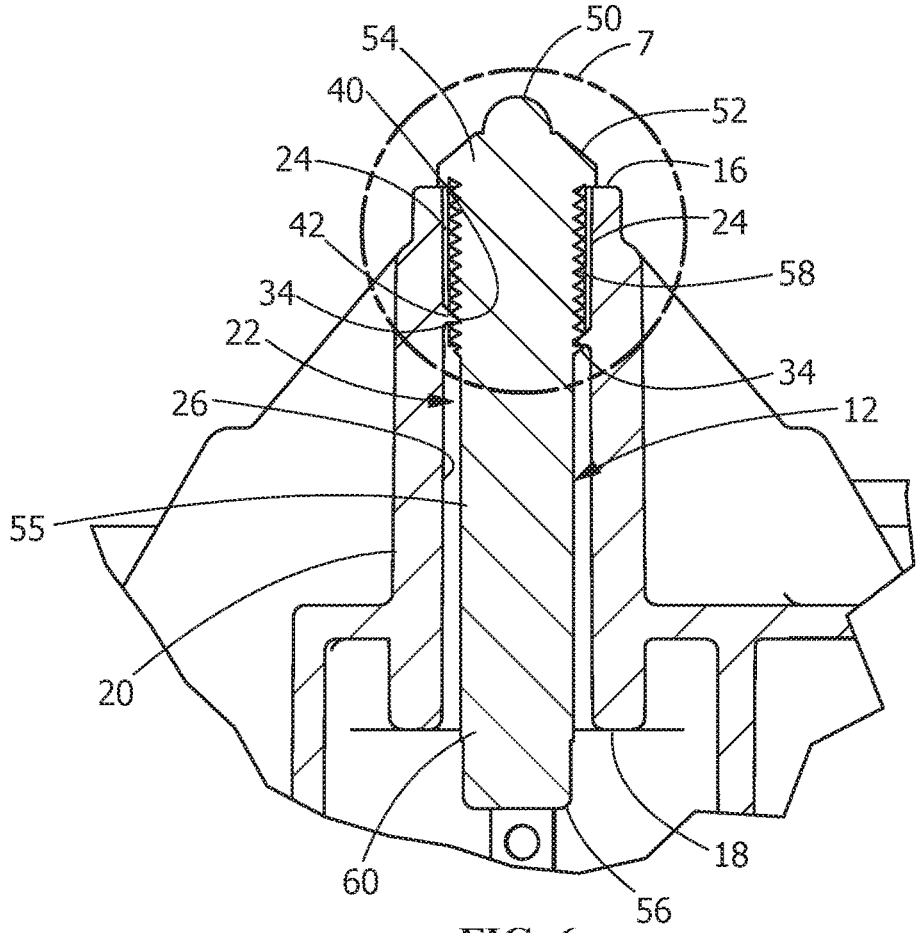
FIG. 6 is a cross-sectional view of the frame member with an LED assembly mounted in an opening of the frame member taken along line 6-6 of FIG. 1.

As shown in FIGS. 2 and 6, a mounting opening 22 is provided in the mounting member 20. The mounting opening 22 extends from the first surface 16 toward the second surface 18. When viewed from the first surface 16, the mounting opening 22 has a diameter D1, as shown in FIG. 2.

Centering ribs 24 are provided about the circumference of the mounting opening 22. The centering ribs 24 extend from a side wall 26 of the opening 22 toward a longitudinal axis 28 of the opening 22. As shown in FIG. 2, the centering ribs 24 are spaced equidistant around the circumference of the mounting opening 22. In the embodiment shown, three centering ribs 24 are provided. However, other numbers, positioning and configurations of the centering ribs 24 may be provided.

Figure 3:
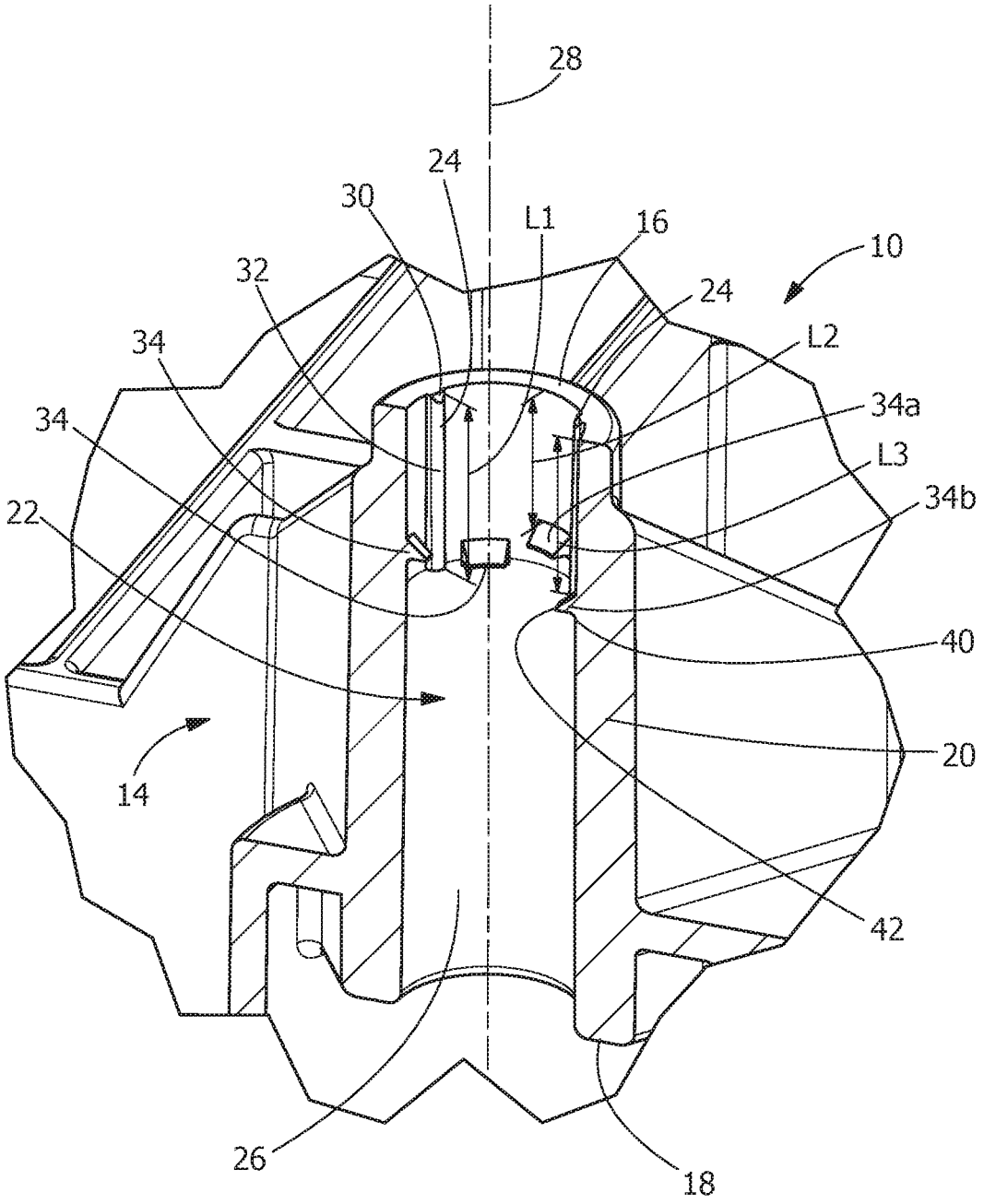
FIG. 3 is a cross-sectional, perspective view of the opening of the mounting member of the frame member.
Figure 5:
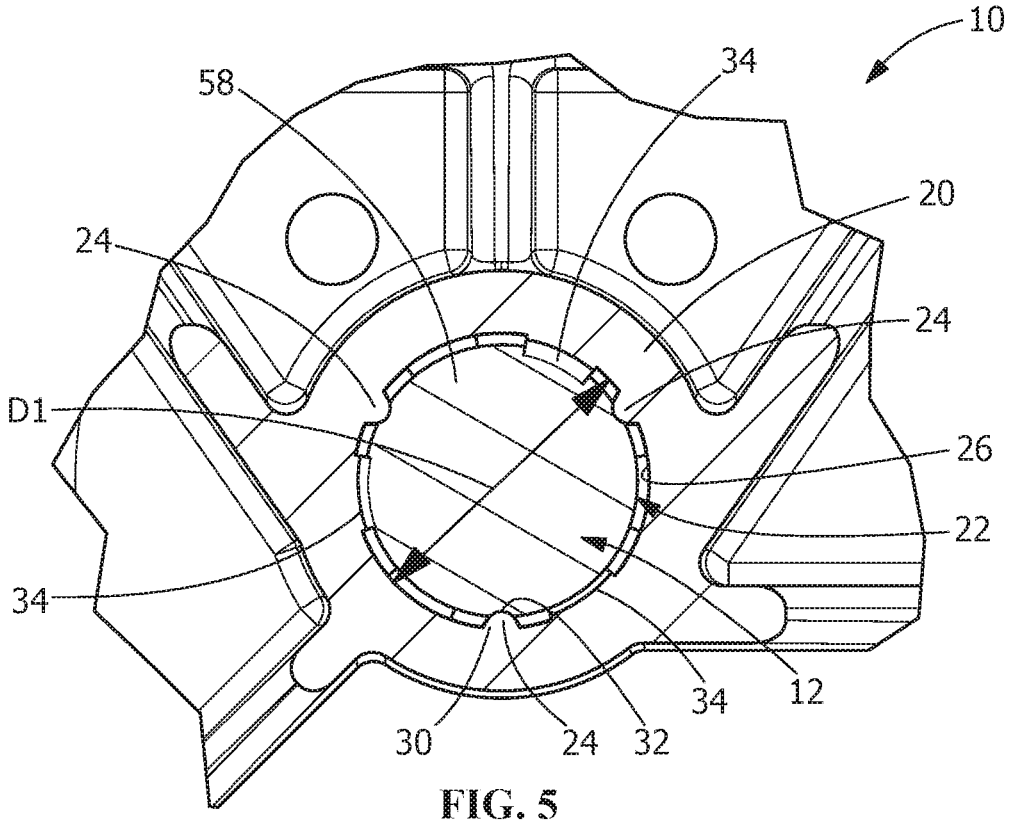
FIG. 5 is a cross-sectional view of the frame member with an LED assembly mounted in an opening of the frame member taken along line 5-5 of FIG. 1.

As shown in FIG. 3, the centering ribs 24 have lengths L1 which extend along the side wall 26 of the mounting opening 22 from proximate the first surface 16 toward the second surface 18 of the mounting frame 10 in a direction which is parallel to the longitudinal axis 28 of the opening 22. As shown in FIGS. 2, 3 and 5, the centering ribs 24 have bases 30 which are attached to the side wall 26 and free ends 32 which extend into the opening 22 toward the longitudinal center axis 28 of the mounting opening 22. The free ends have rounded configurations to prevent the centering ribs 24 from damaging the LED connector assembly 12.

Retention or mounting projections 34 are provided about the circumference of the mounting opening 22. The retention projections 34 extend from the side wall 26 of the opening 22 toward the longitudinal axis 28 of the opening 22. The retention projections 34 are spaced from the centering ribs 24 and are spaced between a distance L2 and a distance L3 (FIG. 3) from the first surface 16 of the mounting frame 10.

As shown in FIG. 2, the retention projections 34 are spaced around the circumference of the mounting opening 22. In the embodiment shown, six retention projections 34 are provided. However, other numbers, positioning and configurations of the retention projections 34 may be provided.

As shown in FIG. 3, the retention projections 34 are staggered, whereby retention projections 34*a* are spaced a distance L2 from the first surface 16 of the mounting frame 10 and retention projections 34*b* are spaced a distance L3 from the first surface 16 of the mounting frame 10. The distance L2 is less than the distance L3. Consequently, the retention projections 34*a* are staggered relative to the retention projections 34*b*, thereby allowing the retention projections 34*a* and the retention projection 34*b* to engage different portions of the LED connector assembly 12 to provide for increased retention of the LED connector assembly 12 in the mounting opening 22 of the mounting member 20 of the frame 10.

Figure 7:
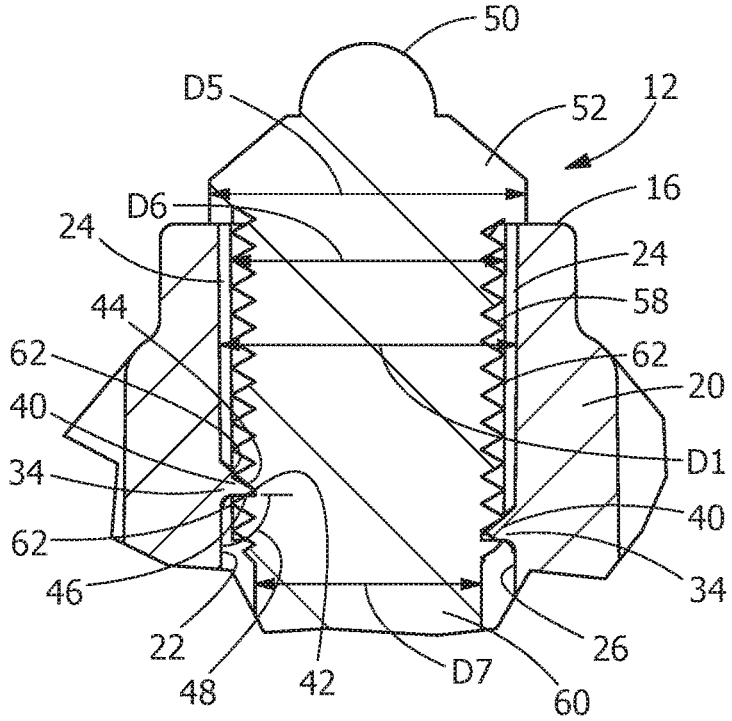
FIG. 7 is an enlarged cross-section view of the opening showing the retention projections in engagement with the mounting portion of the LED assembly. top perspective view of the electrical connector fully inserted into a module housing.

As shown in FIGS. 2, 3, 6 and 7, the retention projections 34 have fixed ends 40 which are attached to the side wall 26 and free ends 42 which extend toward a longitudinal center axis of the mounting opening 22. As shown in FIG. 7, the retention projections 34 have upper sloped or lead-in walls 44 which extend between the fixed ends 40 and the free ends 42 and locking shoulders 46 which extend between the fixed ends 40 and the free ends 42. The lead-in walls 44 are positioned on the side of the retention projections 34 which are closer to the first surface 16. The lead-in walls 44 are sloped from the fixed ends 40 to the free ends 42 in a direction toward the second surface 18. The locking shoulders 46 are positioned on the side of the retention projections 34 which are further from the first surface 16. The locking shoulders 46 are sloped from the fixed ends 40 to the free ends 42 in a direction approximately parallel to or toward the second surface 18. The angle 48 that the locking shoulders 46 project from the side wall 26 is configured to be 90 degrees or less. The free ends 42 have sharp or pointed configurations to allow the retention projections 34 to engage and maintain the LED connector assembly 12 is position. The free ends 32 of the centering ribs 24 are rounded or have an arcuate configuration to prevent the centering ribs 24 from damaging the LED connector assembly 12. The free ends 42 of the retention projections 34 extend toward the longitudinal center axis 28 of the mounting opening 22 further than the free ends 32 of the centering ribs 24.

Figure 4:
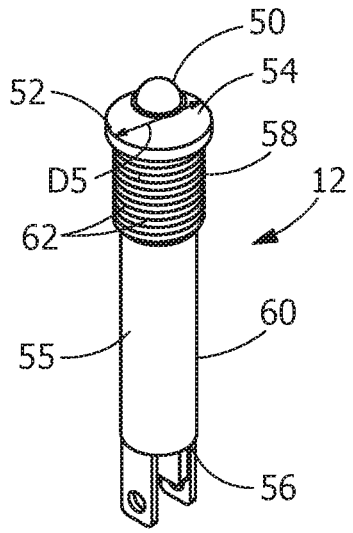
FIG. 4 is a perspective view of an LED assembly for mounting in the opening of the frame member.

Referring to FIGS. 4 and 6, the LED connector assembly 12 has a LED 50 with a first end 52 and a second end 56. A cover 54 surrounds the LED 50 and maintains the LED in position on the LED connector assembly 12. As shown in FIG. 7, the cover 54 has a diameter D5 which is larger than the diameter D1 of the mounting opening 22. A mounting portion 55 extends from the cover 54 toward the second end 56 of the LED connector assembly 12. The mounting portion 55 has a threaded securing portion 58 and a positioning portion 60. The threaded securing portion 58 extends from the cover 54 to the positioning portion 60. The diameter D6 of the threaded securing portion 58 is smaller than the diameter D5 of the cover 54 and smaller than the diameter D1 of the mounting opening 22. The positioning portion 60 extends from the securing threaded portion 58 to the second end 56. The diameter D7 of the positioning portion 60 is smaller than the diameter D6 of the threaded securing portion 58 and smaller than the diameter D1 of the mounting opening 22.

To assemble the LED connector assembly 12 to the frame 10, the LED connector assembly 12 is positioned and secured in the mounting opening 22 of the mounting member 20 of the mounting area 14 of the frame 10. Initially, the LED connector assembly 12 is moved into alignment with the mounting opening 22. The mounting portion 26 of the LED connector assembly 12 is moved into the opening 22. As this occurs, the positioning portion 60 of the LED connector assembly 12 engages the centering ribs 24 of the opening 22, thereby facilitating the proper position of the LED connector assembly 12 in the opening 22 as insertion continues.

As insertion continues, the threaded securing portion 58 of the LED connector assembly 12 is moved into the opening 22. Continued insertion of the LED connector assembly 12 causes the threaded securing portion 58 to engage the centering ribs 24 and the retention projections 34. As the lead-in surfaces 44 of the retention projections 34 are sloped toward the second surface 18, the threaded securing portion 58 can be inserted into the opening 22 without encountering significant force which opposes the insertion. The insertion of the LED connector assembly 12 into the opening 22 is continued until further insertion is prevented by the engagement of the cover 54 with the first surface 16 of the frame 10.

In the fully inserted position, as shown in FIGS. 6 and 7, the free ends 40 of the retention projections 34 are positioned between threads 62 of the threaded securing portion 58 of the LED connector assembly 12. In this position, the locking shoulders 46 of the retention projections 34 engage the threads 62. Because of the angle 48 that the locking shoulders 46 extend from the side wall 26, the retention projections 34 lock the LED connector assembly 12 in position in the opening, thereby preventing the unwanted removal of the LED connector assembly 12 from the opening 22 and the frame 10.

In the fully assembled position, the centering ribs 24 also engage the ends of the threads 62 of the threaded securing portion 58 to properly position the LED connector assembly 12 in the opening 22 and to prevent the unwanted movement of the LED connector assembly 12 in the opening 22.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A mounting frame for mounting an LED connector assembly, the mounting frame comprising:

a mounting opening extending from a first surface of the mounting frame toward a second surface of the mounting frame;

centering ribs provided about a circumference of the mounting opening, the centering ribs being spaced from the first surface, the centering ribs having first lengths which extend along side walls of the mounting opening from proximate the first surface toward the second surface of the mounting frame in a direction which is parallel to a longitudinal axis of the mounting opening, the centering ribs configured to cooperate with the LED connector assembly to center the LED connector assembly in the mounting opening of the mounting frame;

retention projections provided about the circumference of the mounting opening, the retention projections extending from a side wall of the mounting opening into the mounting opening, the retention projections having fixed ends attached to a side wall of the mounting opening and free ends extending toward a longitudinal center axis of the mounting opening, the retention projections having upper sloped walls extending between the fixed ends and the free ends and locking shoulders extending between the fixed ends and the free ends, the upper sloped walls positioned on first sides of the retention projections closer to the first surface, the locking shoulders positioned on second sides of the retention projections further from the first surface, the locking shoulders extending from side wall at an angle of ninety degrees or less as measured at the intersections of the locking shoulders and the side wall, the retention projections being spaced from the centering ribs, the retention projections being spaced between a second distance and a third distance from the first surface of the mounting frame, the second distance and the third distance being larger than the first distance, the locking shoulders of the retention projections configured to cooperate with LED connector assembly to retain the LED connector assembly in position relative to the mounting frame.

2. The mounting frame as recited in claim 1, wherein the centering ribs are spaced equidistant around the circumference of the mounting opening.

3. The mounting frame as recited in claim 1, wherein the centering ribs have rounded configurations with base positioned on the side wall of the mounting opening.

4. The mounting frame as recited in claim 1, wherein the retention projections are spaced periodically around the circumference of the mounting opening.

5. The mounting frame as recited in claim 1, wherein free ends of the retention projections extend from a side wall of the mounting opening toward a longitudinal center axis of the mounting opening a greater distance than free ends of the centering ribs extend from the side wall of the mounting opening toward the longitudinal center axis of the mounting opening.

6. The mounting frame as recited in claim 1, wherein the LED connector assembly inserted into the mounting opening has a mounting portion with a positioning portion and a threaded securing portion, the mounting portion is positioned to cooperate with the centering ribs to center the LED connector assembly in the mounting opening, the threaded securing portion is positioned to cooperate with the retention projections to secure the LED connector assembly in the mounting opening of the mounting frame.

7. An LED assembly comprising:

a mounting frame comprising:

a mounting opening extending from a first surface of the mounting frame toward a second surface of the mounting frame;

centering ribs provided about a circumference of the mounting opening, the centering ribs being spaced from the first surface, the centering ribs having first lengths which extend along side walls of the mounting opening from proximate the first surface toward the second surface of the mounting frame in a direction which is parallel to a longitudinal axis of the mounting opening;

retention projections provided about the circumference of the mounting opening, the retention projections extending from a side wall of the mounting opening into the mounting opening, the retention projections having fixed ends attached to a side wall of the mounting opening and free ends extending toward a longitudinal center axis of the mounting opening, the retention projections having upper sloped walls extending between the fixed ends and the free ends and locking shoulders extending between the fixed ends and the free ends, the upper sloped walls positioned on first sides of the retention projections closer to the first surface, the locking shoulders positioned on second sides of the retention projections further from the first surface, the locking shoulders extending from side wall at an angle of ninety degrees or less as measured at the intersections of the locking shoulders and the side wall, the retention projections being spaced from the centering ribs, the retention projections being spaced between a second distance and a third distance from the first surface of the mounting frame, the second distance and the third distance being larger than the first distance;

an LED connector positioned in the mounting opening, the LED connector having a mounting portion with a positioning portion and a threaded securing portion, the positioning portion being positioned to cooperate with the centering ribs to center the LED connector in the mounting opening, the threaded securing portion being positioned to cooperate with the locking shoulders of the retention projections to secure the LED connector in the mounting opening of the mounting frame.

8. The LED assembly as recited in claim 7, wherein the centering ribs are spaced equidistant around the circumference of the mounting opening.

9. The LED assembly as recited in claim 7, wherein the centering ribs have rounded configurations with bases positioned on the side wall of the mounting opening.

10. The LED assembly as recited in claim 7, wherein the retention projections are spaced periodically around the circumference of the mounting opening.

11. The LED assembly as recited in claim 7, wherein free ends of the retention projections extend from a side wall of the mounting opening toward a longitudinal center axis of the mounting opening a greater distance than free ends of the centering ribs extend from the side wall of the mounting opening toward the longitudinal center axis of the mounting opening.

* * * * *